US006651773B1

(12) United States Patent
Marocco

(10) Patent No.: US 6,651,773 B1
(45) Date of Patent: Nov. 25, 2003

(54) EXHAUST SOUND ATTENUATION AND CONTROL SYSTEM

(76) Inventor: Gregory M. Marocco, 49 Stoney Brook Rd., Montville, NJ (US) 07045

( * ) Notice: Subject to any disclaimer, the term of this patent is extended or adjusted under 35 U.S.C. 154(b) by 0 days.

(21) Appl. No.: 10/252,506

(22) Filed: Sep. 24, 2002

(51) Int. Cl.[7] ..... F01N 1/08; F01N 7/00

(52) U.S. Cl. ..... 181/270; 181/212; 181/275

(58) Field of Search ..... 181/275, 270, 181/268, 252, 222, 249, 251, 256, 257, 212; 60/295, 309

(56) References Cited

U.S. PATENT DOCUMENTS

| | | | | |
|---|---|---|---|---|
| 3,061,416 A | * | 10/1962 | Kazokas | 181/275 |
| 4,393,652 A | * | 7/1983 | Munro | 181/264 |
| 4,541,240 A | | 9/1985 | Munro | |
| 5,014,510 A | | 5/1991 | Laimbock | |
| 5,206,467 A | | 4/1993 | Nagai et al. | |
| 5,220,789 A | | 6/1993 | Riley et al. | |
| 5,248,859 A | * | 9/1993 | Borla | 181/238 |
| 5,388,408 A | | 2/1995 | Lawrence | |
| 5,426,269 A | | 6/1995 | Wagner et al. | |
| 5,477,014 A | | 12/1995 | Dunne et al. | |
| 5,521,339 A | | 5/1996 | Despain et al. | |
| 5,650,599 A | * | 7/1997 | Madden et al. | 181/218 |
| 5,881,554 A | | 3/1999 | Novak et al. | |
| 5,992,560 A | * | 11/1999 | Matsuoka et al. | 181/252 |
| 6,089,347 A | * | 7/2000 | Flugger | 181/264 |
| 6,109,026 A | | 8/2000 | Karlsson et al. | |
| 6,394,225 B1 | * | 5/2002 | Yasuda | 181/256 |

FOREIGN PATENT DOCUMENTS

| | | | | |
|---|---|---|---|---|
| EP | 475398 A1 | * | 3/1992 | F01N/1/02 |
| JP | 62291413 A | * | 12/1987 | F01N/1/10 |
| JP | 02169812 A | * | 6/1990 | F01N/7/00 |
| JP | 06257421 A | * | 9/1994 | F01N/1/08 |

* cited by examiner

*Primary Examiner*—Robert E. Nappi
*Assistant Examiner*—Eduardo Colon-Santana
(74) *Attorney, Agent, or Firm*—Richard C. Litman

(57) ABSTRACT

An exhaust sound attenuation and control system combines the functions of a muffler and resonator in a single, relatively compact device. The internal components of the device may also be coated with one or more emission reduction materials to provide a catalyzing function for the exhaust gases flowing through the system. The present exhaust system provides multiple gas flow paths therethrough, with different paths producing different effects in order to reduce sound output at certain frequencies, as in a resonator, and to attenuate sound throughout a broader frequency range, as in a muffler. The cross-sectional areas of each of the various internal passages and outlet pipe are at least as great, or greater, than the cross-sectional area of the inlet pipe, thereby providing a free flow system with relatively low backpressure.

18 Claims, 5 Drawing Sheets

EXHAUST SOUND ATTENUATION AND CONTROL SYSTEM

BACKGROUND OF THE INVENTION

1. Field of the Invention

The present invention relates generally to exhaust control systems for internal combustion engines, and more specifically to a sound attenuation device including multiple flow paths therein, for reducing exhaust noise throughout the audio frequency range. The present invention is properly considered an exhaust sound attenuation and control system, as it not only reduces sound levels, but may reduce emission levels as well by means of internal coatings of emissions reduction material which provide catalytic reaction of exhaust pollutants passing through the device.

2. Description of the Related Art

While the internal combustion engine has proven to be a reasonably good power source for motor vehicles, it is not without its drawbacks. One of the chief drawbacks of the internal combustion engine is the noise output which results from the rapid burning of fuel in the combustion chambers of the engine, and the rapid expulsion of the hot exhaust gases into the atmosphere. As a result, legislation in virtually every area of the world requires motor vehicles to have equipment which reduces sound output.

Accordingly, mufflers, resonators and other such sound attenuating devices have been known for many years, since shortly after the very earliest development of the internal combustion engine. These two types of sound control devices, i.e., mufflers and resonators, have generally not been combined into a single unit due to conflicting characteristics and physical requirements.

Mufflers are generally installed near the output end of an exhaust system, where the exhaust gases have cooled somewhat, and are adapted to attenuate the sound level of the exhaust through a wide range of frequencies. Relatively low temperature, mild steels are acceptable for such use, with the primary consideration for durability being corrosion resistance. Mufflers operate by passing the exhaust gases through a series of pipes within the muffler shell, with the pipes generally having a series of smaller passages or orifices in their side walls. The exhaust gases are forced through these side passages by the pressure developed by the operating engine, with the muffler serving to attenuate the exhaust sound through a relatively wide range of frequencies.

Many exhaust systems also incorporate a resonator. Resonators are also sound attenuation devices, but operate on a completely different principle than that of the muffler. The resonator is adapted to pass the exhaust gases therethrough with little or no impedance, while canceling or absorbing sounds within a certain relatively narrow and well defined frequency range. This range is generally relatively high, with the muffler being relied upon for the attenuation of lower exhaust frequencies.

The resonator may be placed either upstream or downstream from the muffler, and is used to quiet any noises not damped by the other components of the exhaust system.

While the present invention is primarily directed to various embodiments of an exhaust sound attenuating device which serves the function of both muffler and resonator in a single unit, the present invention may also include means for treating exhaust emissions as well. By the time of the 1950s, it was becoming apparent that the ever increasing volume of automobile and truck traffic was generating exhaust emissions which were adversely affecting the environment. This was particularly true in urban areas and other areas where geographic and meteorological conditions combined to create areas where such emissions do not readily dissipate. Accordingly,. by the late 1960s, various regulations were being implemented to require equipment to reduce exhaust emissions output from automobiles, particularly in California and other urban areas.

While early emissions control efforts provided some relief, standards have become increasingly strict in order to keep pace with the ever increasing volume of automobile and truck traffic throughout the U.S.A. With the development of the catalytic converter, which uses one or more noble metals such as platinum, rhodium, and/or palladium to produce an oxidizing and/or reducing catalytic reaction with the exhaust products and heat generated by the exhaust, a real breakthrough was achieved in the control of vehicle emissions. An automobile equipped with one or more catalytic converters was capable of meeting most, if not all, of the exhaust emissions standards of the time, and the use of catalytic converters became commonplace on automobiles and light trucks powered by spark ignition engines in the U.S.A. More recently, catalytic converters have been developed which incorporate rare earth elements with the noble-metals to increase the efficiency of the catalytic converter.

Catalytic converters require relatively high heat in order to efficiently perform the catalytic chemical reactions necessary to convert exhaust pollutants into relatively innocuous gases. Accordingly, catalytic converters are conventionally installed as closely as possible to the exhaust manifold of the engine itself, and are customarily constructed of relatively high temperature tolerant materials, e.g., corrosion resistant steel. While the present inventor has developed devices which combine the function of the catalytic converter and resonator in a single device, he knows of no single device which combines the functions of the muffler and resonator in a single unit, and which may also include at least some limited catalytic conversion function as well. Such a device would be desirable, as it would save space beneath the vehicle, would reduce weight, and would likely reduce exhaust backpressure in comparison to a series of separate devices. Manufacturing costs for the production of a single device incorporating all of the functions heretofore provided in a series of separate devices would be reduced as well, as would labor costs during vehicle assembly and repair.

The present invention responds to this need by providing a system which combines the functions of the muffler and the resonator in a single device, and which may also incorporate emissions reduction material in order to perform some relatively limited treatment of the exhaust as it passes through the present sound attenuation device. While the present attenuation device will generally be installed somewhat downstream of the conventional catalytic converter, it may be constructed of materials adapted to resist higher temperatures and may be installed somewhat further upstream in the exhaust system, where more efficient catalytic reactions will occur within the device. The present exhaust sound attenuation and control system may be constructed to have any practicable external configuration as desired, and may be constructed as a single unit or as plural, generally parallel units joined by one or more crossover pipes, as desired.

A discussion of the related art of which the present inventor is aware, and its differences and distinctions from the present invention, is provided below.

U.S. Pat. No. 4,541,240 issued on Sep. 17, 1985 to John H. Munro, titled "Exhaust System For Internal Combustion Engines," describes a device having a series of removable foraminous chambers providing sound attenuation, spark and moisture control, and catalytic emission control. While the function of the Munro device is similar to that of the present system, the Munro device has a different internal configuration with exhaust flow having a straighter path. The present system is considerably more compact.

U.S. Pat. No. 5,014,510 issued on May 14, 1991 to Franz Laimbock, titled "Exhaust System, Particularly For Two-Stroke Cycle Internal Combustion Engines," describes an exhaust assembly having a relatively wider expansion area which includes a primary catalytic converter therein. A longitudinal divider is installed upstream of the primary catalytic converter element, with the divider also being coated with catalytically reactive material. It is well known that two stroke cycle exhaust systems are relatively limited in their configurations, as it is critical that the system be tuned so as to assist each exhaust pulse in its passage in order to draw the subsequent pulse or charge from the cylinder, in order to attain optimum efficiency and to preclude overheating of the engine. Accordingly, Laimbock does not provide any internal baffling within his exhaust system in order to attenuate noise levels, as is provided by the present exhaust system.

U.S. Pat. No. 5,206,467 issued on Apr. 27, 1993 to Noboru Nagai et al., titled "Muffler With A Catalyst," describes a relatively small, canister type muffler as used on small two and four stroke engines (e.g., lawnmowers, etc.). The Nagai et al. muffler essentially has four compartments, with a pipe-like first compartment projecting into a second compartment, which communicates with a third compartment which leads to a small fourth compartment with a relatively small exhaust outlet passage. The exhaust gases do not pass longitudinally through a series of elongate passages, as in the present system, and the configuration of the Nagai et al. device cannot provide any resonator effect.

U.S. Pat. No. 5,220,789 issued on Jun. 22, 1993 to James E. Riley et al., titled "Integral Unitary Manifold-Muffler-Catalyst Device," describes an exhaust manifold and system which is bolted directly to the cylinder head of the engine. While Riley et al. include a conventional catalytic converter element, or "brick," within their manifold, they fail to include any internal baffling to control the exhaust sound level within their manifold. The only internal passages within their device are formed by the relatively small, straight passages of the catalytic converter element itself, which Riley et al. prefer to be as nearly straight as possible to encourage laminar flow therethrough. In contrast, the present system provides a circuitous exhaust flow path therethrough, to attenuate noise levels optimally. The present device may include catalytic coatings therein, but does not include a flow-through catalytic converter element per se, as in the Riley et al. device.

U.S. Pat. No. 5,388,408 issued on Feb. 14, 1998 to Phillip G. Lawrence, titled "Exhaust System For Internal Combustion Engines," describes a dual muffler system, in which the mufflers are teed from a single exhaust line upstream, which is in turn fed by one or more catalytic converters. The mufflers of the Lawrence system are essentially straight through devices having a series of pipes therein of different lengths. Little sound attenuation is achieved by such a system, in comparison to the configuration of the present system. While the Lawrence system discloses dual mufflers, their connection to a single point upstream is unlike the dual exhaust embodiment of the present invention.

U.S. Pat. No. 5,426,269 issued on Jun. 20, 1995 to Wayne M. Wagner et al., titled "Muffler With Catalytic Converter Arrangement; And Method," describes a series of embodiments of a muffler having a conventional catalytic converter element axially disposed therein. The path of the exhaust gas flow may take any of a few different routes, depending upon the specific embodiment of the Wagner et al. device. In at least one embodiment, the flow passes axially through the muffler, from one end to the other. In at least one other embodiment, flow doubles back through the muffler shell to exit radially from a port adjacent the axial inlet. None of the embodiments disclose a multiple path internal configuration corresponding to that of the present device.

U.S. Pat. No. 5,477,014 issued on Dec. 19, 1995 to Stephen R. Dunne et al., titled "Muffler Device For Internal Combustion Engines," describes an otherwise conventional muffler, but having an internal coating of zeolite material for protecting the underlying metal structure from corrosion. The Dunne et al. coating does nothing to catalyze exhaust emissions, but is solely directed to the protection of the metal structure of the muffler. Moreover, the Dunne et al. muffler is conventional, as noted above. Among other conventional features, it includes relatively small diameter internal passages, which have diameters smaller than those of the inlet and outlet pipes. This results in excessive flow restriction, which is avoided in the present exhaust system configuration with its relatively large diameter internal passages. U.S. Pat. No. 5,521,339 issued on May 28, 1996 to Michael S. Despain et al., titled "Catalyst Muffler System," describes a relatively small muffler unit intended for use on a two stroke cycle type engine, e.g., chainsaw, lawnmower, etc. The Despain-et al. muffler passes the exhaust gases back over the catalytic converter element therein, after passing through the catalyst element. No multiple paths for exhaust gases is provided by the Despain et al. muffler, and it is noted that the plural internal passages have a total cross-sectional area or diameter which is considerably less than that of the inlet tube, and the outlet passage also has a cross-sectional area less than that of the inlet tube. Such a design results in relatively high backpressure, unlike the present system with its relatively large internal passages.

U.S. Pat. No. 5,881,554 issued on Mar. 16, 1999 to James Michael Novak et al., titled "Integrated Manifold, Muffler, And Catalyst Device," describes a relatively large and bulky assembly having a series of individual exhaust tubes within a larger manifold housing. The tubes lead to a catalytic converter element, with the internal manifold volume also communicating with the catalytic element. The tubes are perforated to allow gas flow to pass therefrom to the internal volume of the manifold, whereby the assembly acts as a resonator. However, while Novak et al. state that their device also serves as a muffler, no muffler elements are disclosed within the device. In contrast, the present system provides multiple flow paths as a muffler and resonator.

Finally, U.S. Pat. No. 6,109,026 issued on Aug. 29, 2000 to Egon Karlsson et al. , titled "Muffler With Catalytic Converter," describes a small canister type muffler for use with relatively small two stroke cycle type engines. The Karlsson et al. muffler has a configuration more closely resembling that of the Nagai et al. '467 and Despain et al. '339 U.S. Pat.s, than the present exhaust system invention. The points of difference raised in the discussion of the Nagai et al. and Despain et al. mufflers, are seen to apply here as well.

None of the above inventions and patents, taken either singularly or in combination, is seen to describe the instant invention as claimed. Thus an exhaust sound attenuation and control system solving the aforementioned problems is desired.

SUMMARY OF THE INVENTION

The present invention comprises an exhaust sound attenuation and control system for use with internal combustion engines of any practicable type and configuration. The present exhaust system generally comprises an outer shell containing multiple flow paths therein for exhaust gases, with the flow paths resulting in the canceling of certain frequencies of exhaust noise (i.e., acting as a resonator) and also lowering exhaust noise generally throughout the frequency range (i.e., acting as a muffler). Internal components of the present exhaust system may be coated with emissions reduction material in order to provide some limited catalyzing of exhaust emissions, as well.

The present exhaust system is configured so that the cross-sectional areas of the internal and outlet pipe passages are at least equal to, and are preferably greater than, the cross-sectional area of the inlet pipe. This provides relatively free flowing characteristics for the present system, thus reducing back pressure in the exhaust system and improving the efficiency of operation of the associated engine.

The present exhaust system is relatively compact, particularly in comparison to the separate muffler and resonator systems of the prior art. The compact, integrated configuration of the present system enables it to be installed at virtually any location in the vehicle exhaust system. The present system may be formed of high temperature resistant materials (e.g., corrosion resistant steel, etc.), as required, for installing adjacent to the vehicle engine.

The combining of the functions of previously separate components into a single unit, results in significant savings in manufacturing costs, as well as in savings in time and labor during vehicle manufacture and repair. The compact nature of the present exhaust system invention results in lighter weight than assemblies of the prior art, thus further increasing vehicle efficiency. The present exhaust system may be manufactured in a variety of external configurations, each having essentially the same internal configuration. This allows the present system to be adapted to a wide range of different vehicles. Moreover, the present system may be adapted for use as a single or dual system, with crossover pipes as required. The crossover pipes may comprise a single pipe or a plurality of pipes between two or more exhaust control devices of the present invention, and may connect similar or dissimilar chambers or passages within the different devices, as desired, to enhance the versatility of the system.

Accordingly, it is a principal object of the invention to provide an exhaust control system for an internal combustion engine, which system combines and includes features and functions of a muffler and resonator, and which may also include a catalytic conversion function as well.

It is another object of the invention to provide such an exhaust control system having a plurality of alternative flow passages therethrough, for controlling exhaust sound through a wide range of frequencies.

It is a further object of the invention to provide such an exhaust control system having a free flow configuration, with the cross-sectional area of each internal passage and the outlet passage being at least equal to, and preferably greater than, the cross-sectional area of the inlet passage.

Still another object of the invention is to provide such an exhaust control system which may be constructed in any of a number of different external configurations to fit various installations, and which may be provided in a parallel array of two or more units having crossover pipes therebetween, if so desired.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an exhaust system for attenuating the sound, and optionally treating the emissions, of an internal combustion engine. The present exhaust system is more than just a muffler, and combines aspects of a muffler with aspects of a resonator unit as well. Optionally, the present system may incorporate catalytic materials for emissions treatment of the exhaust gases flowing therethrough, as noted above. Thus, the present exhaust treatment system provides a more compact, lighter weight, and more economical device for treating and controlling sound and other emissions of the exhaust of an internal combustion engine, replacing the multiple units required by conventional exhaust systems.

Figure 1:
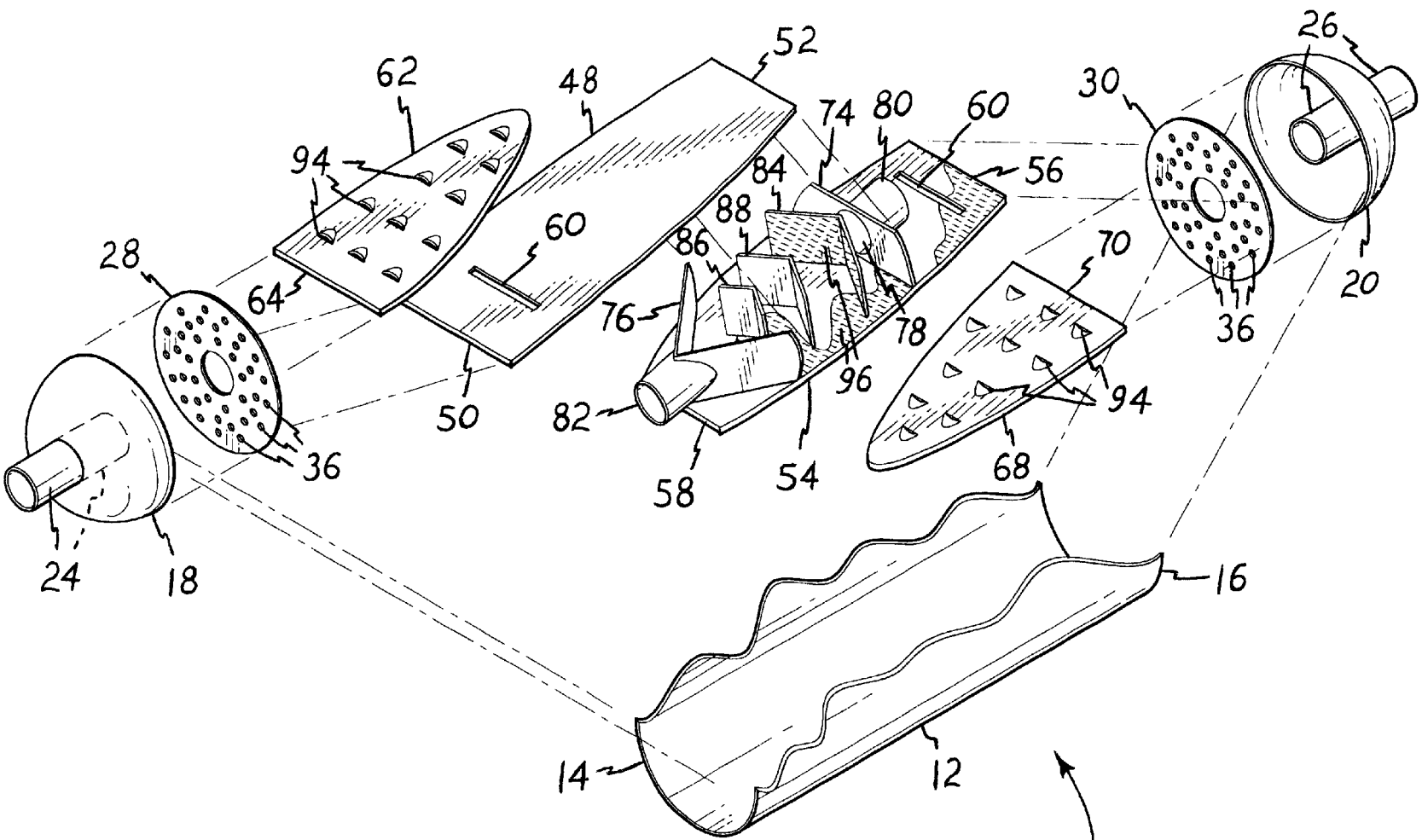
FIG. 1 is an exploded perspective view of an exhaust sound attenuation and control system according to the present invention, showing its components and their relationship to one another.
Figure 2:
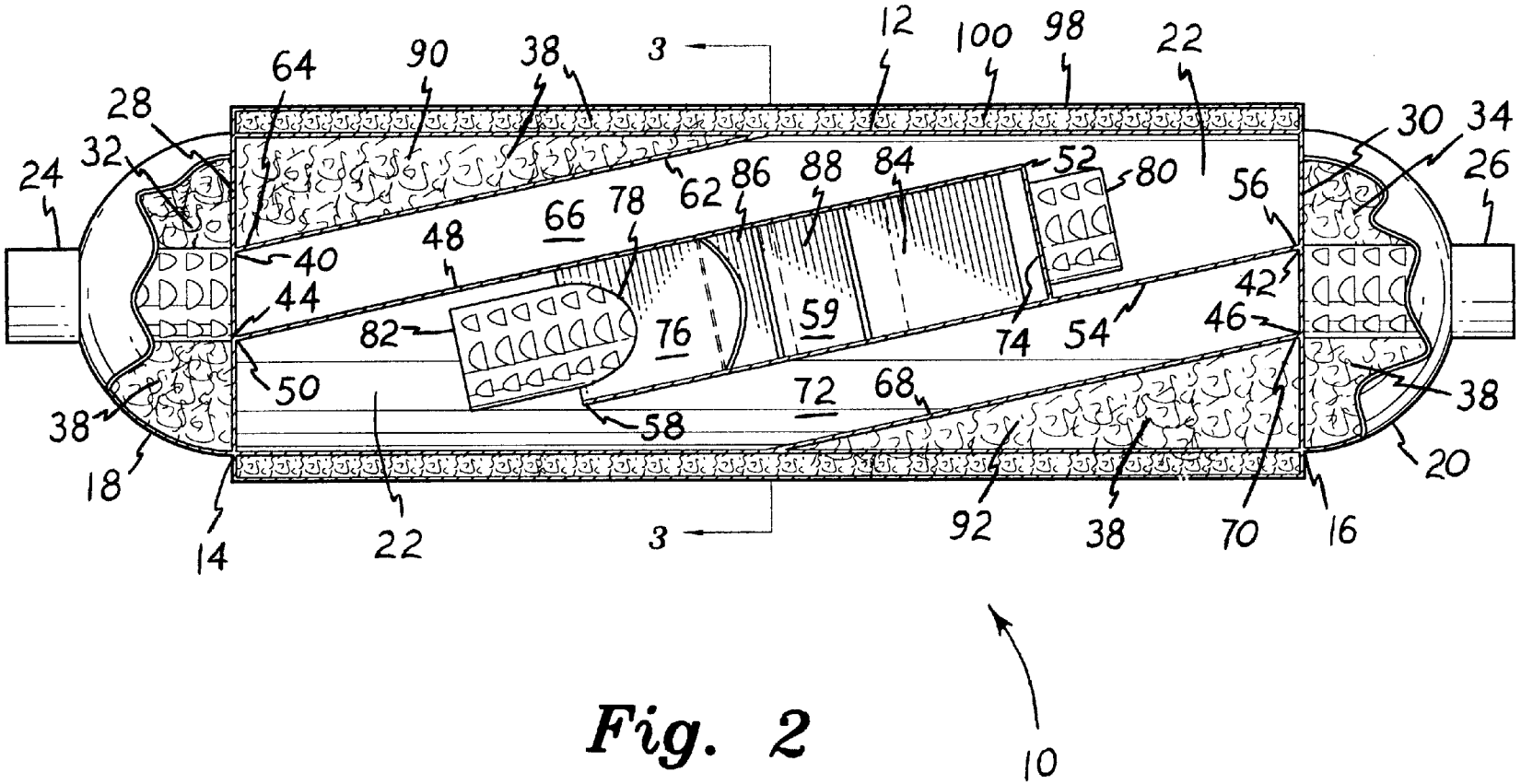
FIG. 2 is an elevation view in section of the present assembled exhaust system, showing further details thereof and the flow path through the device.
Figure 3:
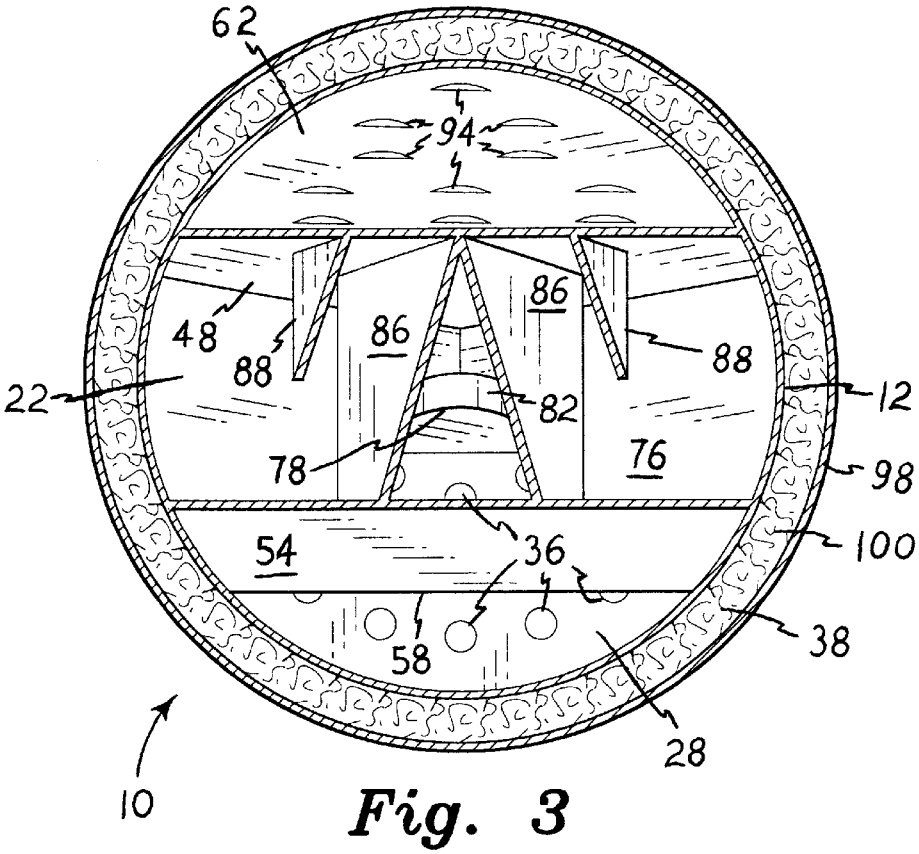
FIG. 3 is an elevation view in section of the present exhaust system along line 3—3 of FIG. 2.

FIGS. 1 through 3 of the drawings provide exploded perspective and sectional views of a first embodiment 10 of the present exhaust system, comprising a generally cylindrical unit. The internal components of the exhaust system 10 are enclosed in an elongate external housing or shell 12 (shown with one side broken away in FIG. 1, for clarity in the drawing FIG.) having an inlet end 14 and opposite outlet end 16. Each end 14 and 16 of the housing 12 has an end plate sealed thereto, respectively inlet end plate 18 and outlet end plate 20. These end plates 18 and 20 may comprise convex hemispherical shells, as shown, or may be flat or have some other shape, as desired. The additional internal volume of the illustrated convex hemispherical end plates 18 and 20 may provide additional benefits, as discussed further below.

The external housing 12, inlet end plate 18, and outlet end plate 20 define an internal volume 22 (indicated in FIGS. 2 and 3) which is sealed from the outer environment except for their respective inlet pipe 24 and outlet pipe 26. In the case of the hemispherical inlet and outlet plates 18 and 20, the inlet and outlet pipes 24 and 26 preferably penetrate their respective inlet and outlet plates 18 and 20 to exit through the centers of inlet and outlet internal end plates, respectively 28 and 30. These internal end plates 28 and 30 define respective inlet and outlet end volumes 32 and 34, which may provide additional benefits in the treatment of the exhaust gases passing through the present system.

Each of the internal end plates 28 and 30 may include a series of perforations 36 therethrough, which allow exhaust gases to circulate into the inlet and outlet end volumes 32 and 34 of the system. These end volumes 32 and 34 may include some form of sound absorbent material 38 installed therein (shown in FIG. 2, e.g., glass fiber roving, etc.) to provide additional sound control, depending upon the sound level output of the engine, the size and sound control attributes of the remainder of the system, and the sound output level and quality desired. It will also be seen that the internal end plates 28 and 30 may be made considerably longer or thicker than shown in the drawings, and with their passages or perforations 36 coated internally with a catalytically reactive material, may provide a significant catalytic conversion effect when the system is modified to provide a net exhaust flow through the end volumes 32 and 34.

While FIG. 1 illustrates the various components which comprise the present exhaust system 10, FIG. 2 provides an illustration of the exhaust gas flow paths which pass through the system 10. For the sake of reference to the installation positions of the various internal panels, plates, and baffles comprising the internal structure of the device 10, the inlet and exhaust pipes 24 and 26 are considered to have a first side, respectively 40 and 42, and an opposite second side, respectively 44 and 46, indicated in FIG. 2 of the drawings. The diameter across the two sides 40, 44 of the inlet pipe 24 and sides 42, 46 of the outlet pipe 26, define their respective cross-sectional areas. This is an important consideration for the flow of exhaust gases to, from, and through the present system 10, as discussed further below.

A first separator panel or baffle 48 has a first end 50 which is sealed to the inlet end plate 18 (or more properly, across the internal inlet plate 28, when the exhaust system 10 is so equipped) adjacent the second side 44 of the inlet pipe 24. This first separator panel 48 is sloped relative to the longitudinal axis of the system 10, and extends angularly through the majority of the length of the housing 12 toward the internal wall of the housing 12, where it terminates at its second end 52. The second end 52 of the first separator panel 48 is spaced away from the internal surface of the housing 12, and defines a cross-sectional area therebetween. This cross-sectional area is in the form of a circular segment, and is at least as great as (or greater than) the cross-sectional area of the inlet pipe 24.

A second separator panel 54 has a first end 56 which is sealed to the outlet end plate 20, or across the internal outlet plate 30 when the exhaust system 10 is so equipped, adjacent the first side 42 of the outlet pipe 26. The second separator panel 54 is also sloped relative to the longitudinal axis of the system 10, and extends angularly through the majority of the length of the housing 12 toward the internal wall of the housing 12, where it terminates at its second end 58. The two separator panels 48 and 54 are preferably substantially parallel to one another, and define an exhaust gas intermediate chamber 59 therebetween, as discussed further below. The second end 58 of the second separator panel 54 is also spaced away from the internal surface of the housing 12 and defines a cross-sectional area therebetween, essentially like the cross-sectional area between the second end 52 of the first separator panel 48 and the wall or housing 12 of the assembly 10. As in the case of the first separator panel 48, the cross-sectional area between the second end 58 of the second separator panel 54 is also at least as great as (or greater than) the cross-sectional, areas of the inlet and outlet pipes 24 and 26.

Each of the two separator panels 48 and 54 includes a lateral exhaust gas pressure balance passage 60, which extends thereacross and near the respective first ends 50 and 56 of the two panels 48 and 54. These two pressure balance passages 60 provide alternative exhaust gas passages through the interior 22 of the system 10, with pressure pulses on each side of the panels 48 and 54 tending to cancel one another through the balance passages 60.

A first supplementary panel 62 has a first end 64 which is sealed across the internal surface of the inlet end plate 18 (or to its associated internal plate 28) adjacent the first side 40 of the inlet pipe 24, and extends angularly through substantially the first half of the length of the system 10. The outer edge of the supplementary panel 62 forms a parabolic curve, in keeping with its juncture with the cylindrical internal surface of the housing 12. It will be seen that the supplementary panel 62 may have any suitable peripheral shape adapted to mate closely with and seal along the internal surface of the housing 12, depending upon the shape of the housing 12. The first supplementary panel 62 is preferably parallel to the first separator panel 48, and along with the housing 12 walls, defines an exhaust gas inlet chamber 66 therebetween, as shown in the side elevation in section of FIG. 2.

A second supplementary panel 68 has a first end 70 sealed across the internal surface of the outlet end plate 20, or to its associated internal plate 30, adjacent the second side 46 of the outlet pipe 26, and extends angularly through substantially the second half of the length of the system 10. (The section line 3—3 in FIG. 2, is located at the center of the length of the device.) The outer edge of the second supplementary panel 68 is also sealed along the internal wall of the housing or shell 12, similarly to the first supplementary panel 62. The second supplementary panel 68 is preferably parallel to the second separator panel 54, and along with the housing 12 walls, defines an exhaust gas outlet chamber 72 therebetween.

The above described layout of the various panels or baffles 48, 54, 62, and 68 results in the inlet chamber 66, intermediate chamber 59, and outlet chamber 72 communicating with one another sequentially, as the exhaust gases flow from the inlet pipe 24 into the inlet chamber 66, through the gap between the second end 52 of the first separator panel 48 and the housing 12, back through the intermediate chamber 59, then through the gap between the second end 58 of the second separator panel 54 and the housing 12, through the outlet chamber 72, and finally out the outlet pipe 26. This sinusoidal primary exhaust gas pathway is at least two and one half times the external length of the system 10, due to the lengths of the two separator panels 48 and 54 extending within the housing 12 for some three quarters of the length of the housing 12, along with the additional internal entry and exit pipes (discussed further below) for the intermediate passage area 59.

The intermediate chamber 59 further includes a series of generally lateral baffles or vanes thereacross, which serve to further attenuate the sound of the exhaust as it passes through the present system 10. Intermediate chamber entry and exit baffles, respectively 74 and 76, extend laterally across the entry and exit ends of the intermediate passage area 59. These baffles extend completely across the interior of the housing 12, extending from the second end 52 of the first separator panel 48 to the second separator panel 54 (for the entry baffle 74) and from the second end 58 of the second separator panel 54 to the first separator panel 48 (for the exit baffle 76).

These two baffles 74 and 76 seal the intermediate passage area 59, with the exception of their passages 78 through which all exhaust gases must pass to travel into and from the intermediate chamber 59. Each internal baffle passage 78 may include a supplementary pipe extending therefrom, with the entry baffle 74 having an internal entry pipe 80 extending therefrom and toward the outlet end 16 of the system 10, and the exit baffle 76 having an exit pipe 82 extending therefrom and toward the inlet end 14 of the system 10. These two. internal pipes 80 and 82 add some additional length to the intermediate chamber 59 for further tuning effect, and serve to duct and guide the exhaust gases into and from the intermediate chamber 59.

The intermediate chamber 59 further includes a series of generally chevron-shaped intermediate baffles or vanes extending between the two separator panels 48 and 54, and installed between the intermediate chamber entry and exit baffles 74 and 76. These baffles or vanes extend from a relatively wider first intermediate baffle 84 to a relatively narrower last intermediate baffle 86, with one or more secondary intermediate baffles 88 disposed therebetween. Each of these intermediate baffles 84 through 88 is oriented with the apex of the V facing the intermediate chamber entry baffle 74, and extends between the two separator panels 48 and 54. However, some lateral space is provided for exhaust gas flow around the ends of the intermediate baffles 84 through 88, with each of the baffles 84 through 88 having a narrower width from the entry baffle 74 toward the opposite exit baffle 76.

The orientation of the V-shaped intermediate baffles or vanes 84 through 88 results in the pressure pulses of the exhaust gases flowing through the intermediate chamber 59, flowing around the lateral edges of the baffles 84 through 88 and tending to cancel therebetween. The various sizes of baffles 84 through 88 results in the canceling of a relatively broad spectrum or frequency range of exhaust noise. The internal entry pipe 80, which passes through the passage 78 of the first or entry baffle 74, serves to guide the exhaust gases toward the first intermediate baffle or vane 84, with that baffle 84 dividing the gases therearound to either side thereof. The V-shape of the final or exit baffle 76, is opposite the orientation of the intermediate baffles 84 through 88 and serves to collect the exhaust energy flowing from the intermediate chamber 59 and direct it from that chamber 59 by means of the exit passage 78 therethrough (shown in FIG. 2) and internal exit pipe 82 extending therefrom.

It will be noted that the two supplementary panels 62 and 68, along with the adjacent areas of the external housing 12, define first and second supplementary volumes 90 and 92 in the device 10. The two supplementary panels 62 and 68 are provided with a series of perforations or passages 94 therethrough, which allow the pressure pulses of the exhaust gases to flow into the supplementary volumes 90 and 92, at least to some extent. This provides further frequency cancellation of exhaust noises and sounds in the present exhaust system 10. These passages 94 may be in the form of semicircular arcs, as shown, or some alternative shape as desired.

It will be further noted that many of the other various panels and components, e.g., the two internal pipes 80 and 82, may also be provided with a series of perforations or passages 94 therethrough. Similarly, the internal portions of the inlet and outlet pipes 24 and 26 may also be provided with such passages 94. These passages 94 serve to guide some portion of the exhaust flow into other areas of the system 10, thereby providing alternative flow paths for exhaust gases flowing through the present exhaust system 10. This further breaks up the gases and their pressure pulses, thus further attenuating such pressure pulses and the corresponding noise produced by such pressure pulses. The various areas of the present exhaust system 10 which do not experience a net flow of exhaust gases therethrough, e.g., the two supplementary volumes 90 and 92, may be filled with a sound absorbent material 38 such as glass fiber roving or matting, or other suitable material as desired, in the manner discussed further above for filling the end volumes 32 and 34 of the exhaust system 10.

The present exhaust system 10 may accomplish more than merely controlling the sound level of exhaust gases passing therethrough. Present technology incorporates separate catalytic converter elements for breaking down unburned hydrocarbons and oxides of nitrogen in exhaust gases. While the present system 10 does not provide the thorough processing of exhaust gases that a conventional catalytic converter does, the present system may still incorporate internal coatings 96 of emission reduction material therein if so desired, e.g., platinum, rhodium, palladium, etc.

The relatively free flow characteristics of the present exhaust system result in a relatively small percentage of the exhaust gases actually contacting the internal surfaces of the device 10. However, coating the internal surfaces with a catalytic conversion coating 96 as shown in FIG. 1, e.g., the internal surface of the housing 12, the separator panels 48 and 54, the supplementary panels 62 and 68, the entry, exit, and intermediate baffles or vanes 84 through 88, etc., nevertheless does provide some additional reduction in exhaust emissions. (Not all surfaces are shown with the coating detail, for clarity in the drawing FIG.) Moreover, the two end internal plates 28 and 30 may be made thicker to incorporate a significant amount of catalytically reactive material within their internal passages 36, and the internal construction may be modified to route substantially all of the gases through the end chambers 32 and 34, as noted further above. Thus, the present exhaust system 10 may accomplish essentially all of the required functions of exhaust treatment in a single device, i.e., muffling the overall sound level, resonating certain frequencies, and catalytically treating the exhaust emissions.

FIGS. 2 and 3 illustrate another variation which may be incorporated with the present exhaust system 10. In FIGS. 2 and 3, an additional, secondary or outer shell 98 is provided, surrounding the inner shell of the housing 12 and defining a housing volume 100 therebetween. The volume 100 therebetween may be filled with sound absorbent material 38 to quiet the present exhaust system 10 further, and/or the inner shell may be perforated, if so desired.

Prototypes have been constructed of the present exhaust system 10, and tested upon a series of different automobiles having different engines. A table showing the results of this testing, is provided below.

TABLE I

TEST RESULTS

| SYSTEM TYPE | LENGTH | DIAMETER | IDLE dB | HIGH RPM dB |
|---|---|---|---|---|
| FEDERAL STANDARDS (STANDARD VEHICLE) | N/A | N/A | 79–85 | |
| FEDERAL STANDARDS (HIGH PERFORMANCE VEHICLE) | N/A | N/A | 85–98 | |
| FORD 4.6 LITER ENGINE, OPEN EXHAUST | N/A | N/A | 85–87 | |
| FORD 4.6 LITER ENGINE, WITH RESONATOR AND MUFFLER | 23 in. | 10.5 × 6 in. (Rectangular, unitary assembly) | 70–73 | 88 |
| FORD 3.0 LITER ENGINE, WITH RESONATOR AND MUFFLER | 23 in. | 10.5 × 6 in. (Round resonator with separate oval muffler) | 71–73 | |
| TENNECO ULTRA FLOW MUFFLER | 30 in. | 6 in. Dia. | 73–75 | |
| MAROCCO SYSTEM, (WITHOUT INTERNAL PACKING INSULATION), TESTED ON FORD 4.6 LITER ENGINE | 22.5 in. | 6 in. Dia | 74–75 | 88 |
| MAROCCO SYSTEM (WITH INTERNAL PACKING INSULATION), TESTED ON FORD 4.6 LITER ENGINE | 22.5 in. | 6 in. Dia. | 71–73 | 88 |

The above test results indicate that the present exhaust system, which combines features of both a muffler and a resonator within a single unit, results in a considerably more compact sound attenuation device than the mufflers and resonators of the earlier art, while still quieting exhaust output to essentially the same levels. The prior art systems range from 23 to 30 inches in length, with diameters or widths from 6 to 10.5 inches. The length and diameter of the system illustrated herein in FIGS. 1 through 3, are equal to or slightly less than the smallest dimensions of any of the units of the prior art listed in the table above. The smaller overall size of the present unit equates to less material used in construction, and thus lower cost for the present exhaust system in comparison to earlier units. Moreover, the smaller size makes the present system easier to "package" in an automotive installation, providing engineers with greater freedom in designing exhaust installations in automobiles (and/or other reciprocating engine installations to which the present system may be adapted).

Conventional thought in the industry is that the shape of an exhaust system (muffler and resonator) are important to the sound attenuating qualities of the system, with all other factors being equal. Units having oval, rectangular, or other non-circular cross sections, generally attenuate noise better than round systems. Yet, the industry is tending toward round exhaust systems, in order to save packaging space during installation. The present system provides sound attenuation equal to that of larger, non-circular systems, in a small, compact, circular cross section system.

FIGS. 4 through 8 provide perspective views of various alternative cross-sectional shapes which may be adapted for use with the present exhaust system invention. Such non-circular cross-sectional shapes may provide certain advantages in sound attenuation in comparison to a cylindrical unit, as noted above. In any event, the internal baffling and routing of the exhaust through any of the units illustrated in FIGS. 4 through 8, remains essentially the same as that illustrated for the cylindrical system 10 of FIGS. 1 through 3.

Figure 4:
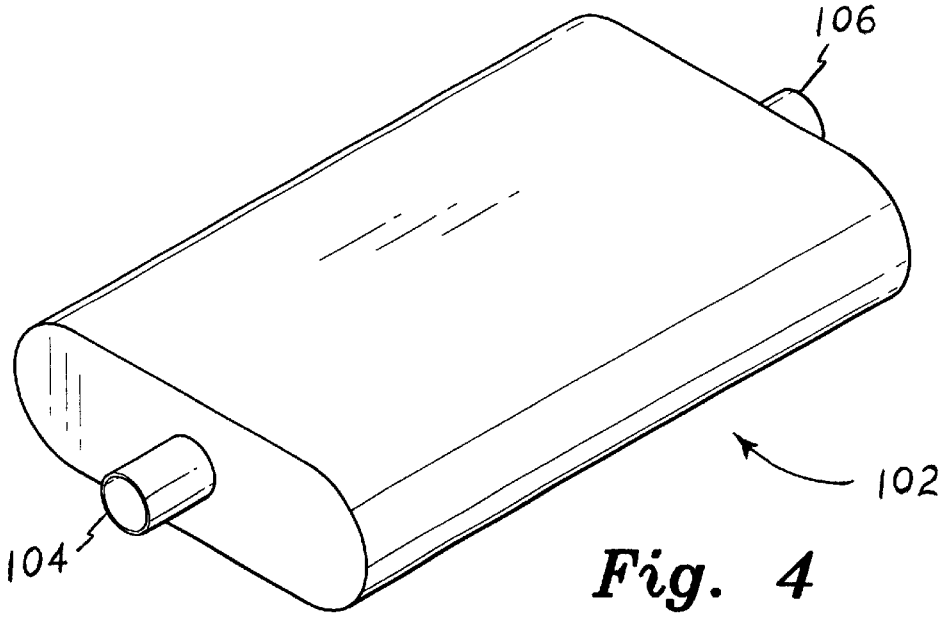
FIG. 4 is a perspective view of an alternative embodiment of the present exhaust system, comprising an external shell having an oval cross-section.

In FIG. 4, an exhaust sound attenuation device 102 is illustrated, having a generally oval cross-section. It will be noted that the inlet pipe 104 and outlet pipe 106 are concentric with one another, and are aligned substantially with the center of the device, as is the case with the inlet and outlet pipes 24 and 26 of the exhaust system 10 of FIGS. 1 through 3. The separator and supplementary panels within the system 102 of FIG. 4, may be sloped or angled across the major dimension or width of the housing, with these panels and other baffles laterally spanning the narrower dimension of the device. Also, while the two ends of the oval system 102 are shown as being flat, it should be noted that convex end panels may be installed upon the exhaust device 102 of FIG. 4, if so desired, similarly to the convex end plates 18 and 20 of the exhaust system 10 of FIGS. 1 through 3. Internal plates, similar to the plates 28 and 30 of the system 10 of FIGS. 1 through 3, may be installed within such convex end plates, if so desired.

Figure 5:
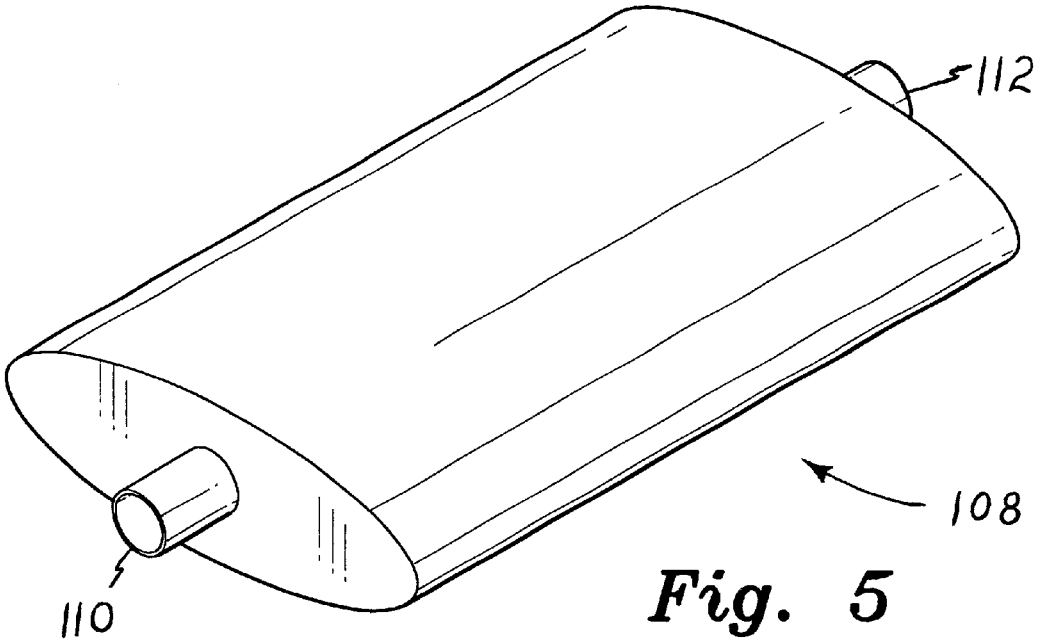
FIG. 5 is a perspective view of an alternative embodiment of the present exhaust system, comprising an external shell having an elliptical cross-section.

FIG. 5 illustrates another embodiment of the present exhaust system, in which the exhaust sound attenuation device 108 has an elliptical cross-section. As in the case of the exhaust systems 10 and 102 of FIGS. 1 through 4, the exhaust system or device 108 includes an inlet pipe 110 and outlet pipe 112, which are aligned substantially concentrically with the center of the system. The elliptical cross-sectional shape of the exhaust system 108 of FIG. 5 is essentially a variation on the oval shape of the exhaust system 102 of FIG. 4, with internal components, end plates, etc. having the same configuration and alternative configurations.

Figure 6:
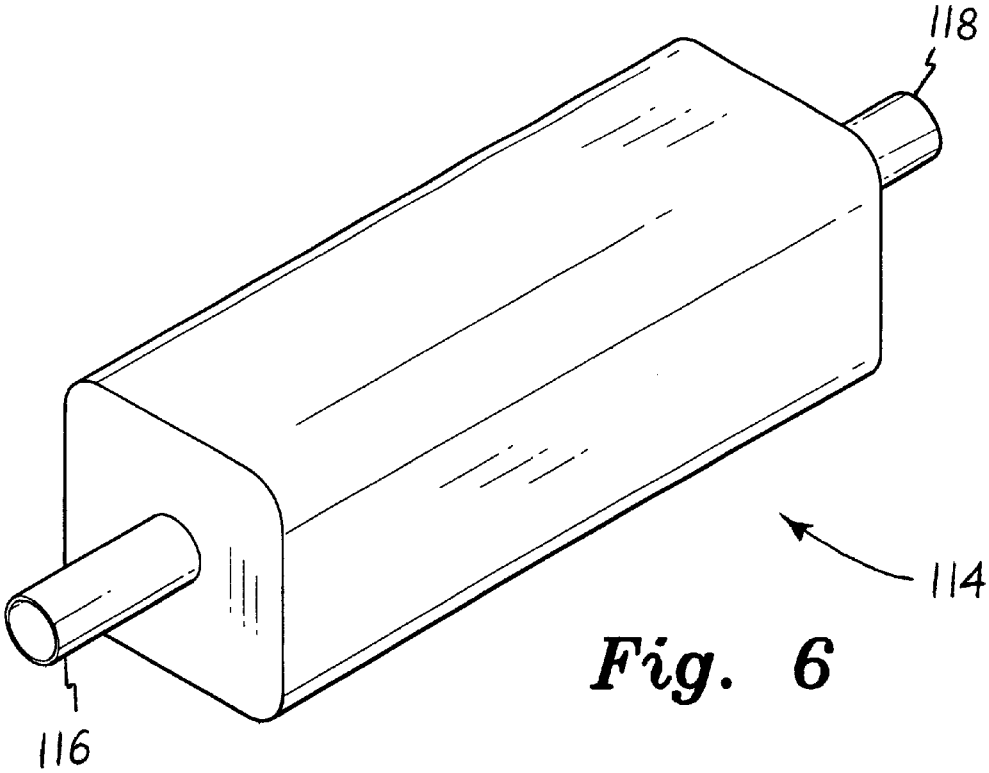
FIG. 6 is a perspective view of an alternative embodiment of the present exhaust system, comprising an external shell having a rectangular cross-section.

FIG. 6 provides an illustration of yet another variation or embodiment of the present exhaust sound attenuation system, wherein the system 114 has a substantially square, or at least rectangular, cross-section. The exhaust system 114 may be either square or rectangular in cross-section, with it being recognized that these two shapes are essentially variations of one another, with the square shape shown for the device 114 of FIG. 6 being a special case in which the widths of each of the sides are identical to one another. Again, the inlet pipe 116 and outlet pipe 118 of the exhaust system 114 are substantially concentric with one another and with the main shell or housing of the device. The internal configuration of the exhaust system 114 is essentially the same as that illustrated for the cylindrical device 10 of FIGS. 1 through 3, with the widths of the various internal components being adjusted to fit the square or rectangular shape of the exhaust system 114 as required.

Figure 7:
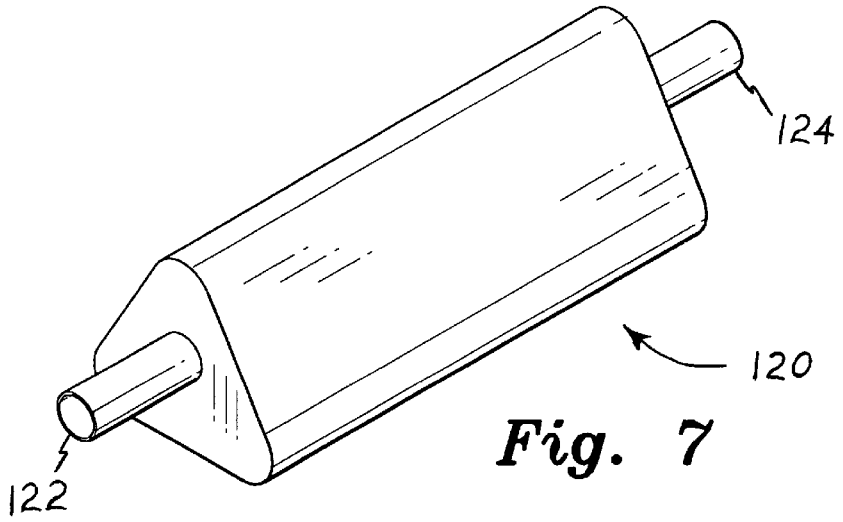
FIG. 7 is a perspective view of an alternative embodiment of the present exhaust system, comprising an external shell having a triangular cross-section.

FIG. 7 illustrates still another embodiment of the present exhaust system invention, in which the device 120 has a generally triangular cross-section. As in the other embodiments of the present invention, the inlet and outlet pipes 122 and 124 may be installed concentrically with one another and with the main body or shell of the device. While a generally equilateral triangular shape is illustrated for the exhaust system 120 of FIG. 7, it will be seen that the cross-sectional shape may be flattened or altered to form an isosceles or other triangular shape as required to fit a given installation space.

Figure 8:
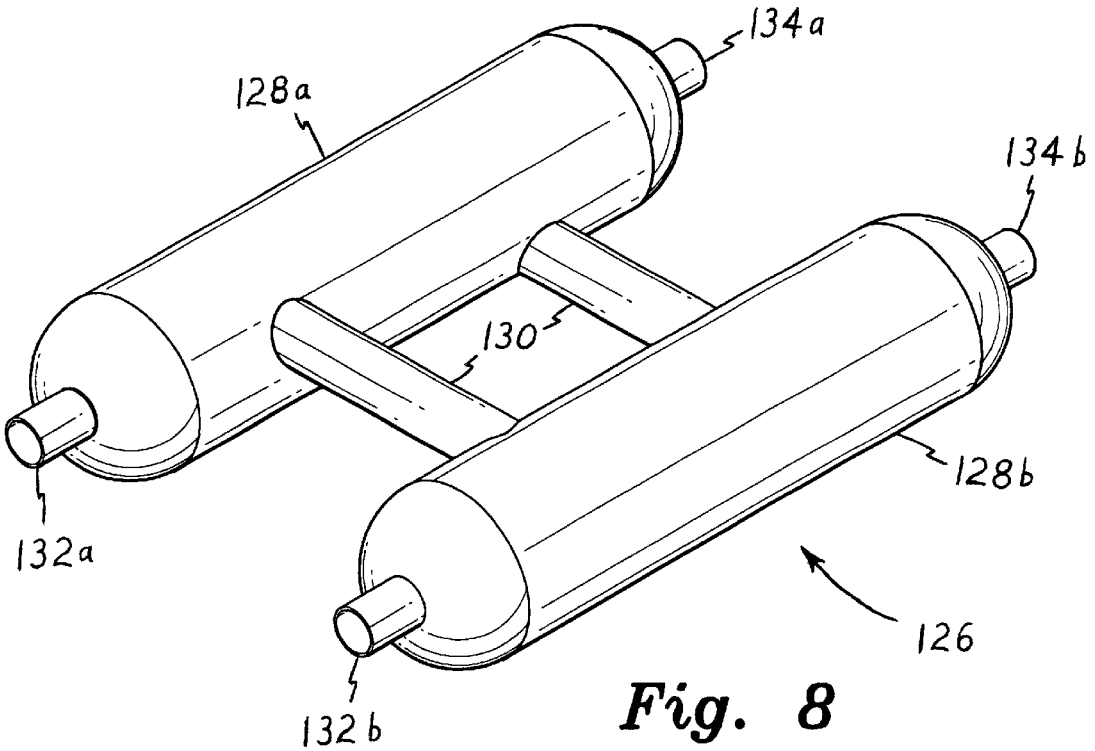
FIG. 8 is a perspective view of an alternative embodiment of the present exhaust system, comprising two parallel devices joined by a pair of crossover pipes therebetween.

FIG. 8 illustrates an exhaust sound attenuation system embodiment 126 wherein two cylindrical units 128*a* and 128*b* are installed parallel to one another in a dual exhaust system. The two individual units 128*a* and 128*b* are interconnected by one or more crossover pipes 130, which allow exhaust gases to pass between the two units 128*a* and 128*b*. The dual system 126 is particularly useful in V-type engines, where each cylinder bank has its own individual exhaust system. Each individual system includes an inlet pipe, respectively 132*a* and 132*b* for the two units 128*a* and 128*b*, and an opposite outlet pipe, respectively 134*a* and 134*b* for the two units 128*a* and 128*b*. Each unit 128*a* and 128*b* is essentially similar to the cylindrical unit 10 illustrated in FIGS. 1 through 3, with the exception of the crossover pipes 130 which allow exhaust gases to communicate between the two units 128*a* and 128*b*. The interconnection of the two units 128*a* and 128*b* tends to balance the exhaust gas pulses flowing through either of the individual units 128*a* or 128*b*. It will be understood that the crossover pipes may connect between similar chambers or passages within the two units 128*a* and 128*b*, or may interconnect different chambers or passages between the two units, depending upon the desired effect. Also, while only two units 128*a* and 128*b* are illustrated in FIG. 8, it will be appreciated that the interconnection of similar or dissimilar chambers or passages between more than two units, using more than two crossover pipes, may be accomplished, if so desired.

In conclusion, the present exhaust sound attenuation and control system provides numerous advantages over earlier systems of the prior art. The combination of muffler and resonator principles within a single exhaust sound attenuation device, provides significant benefits in packaging of such a system in the limited space available beneath a motor vehicle structure, or in other areas where space is critical. Moreover, the relatively compact nature of the present system provides benefits in terms of material, and therefore costs, during manufacture. The relatively small size and low material requirements, results in relatively light weight as well, which reduces shipping costs as well as reducing the overall weight of the motor vehicle or other powerplant with which the present exhaust system may be used.

The present exhaust system provides further versatility, in that the internal components may be coated with catalytically reactive materials, in order to provide further cleaning of the exhaust gases passing therethrough. It has been noted in the present disclosure, that certain elements of the present system may be deepened or enlarged, and flow patterns revised, to provide exhaust emissions control on the order of that achieved by conventional catalytic converters. Yet, the free flow configuration of the present system, wherein each of the internal passages has a net cross-sectional area at least equal to (or perhaps greater than) the cross-sectional areas of the inlet pipe, provides good efficiency and assures that relatively low back pressures occur in the present system.

While conventional mufflers and resonators are constructed primarily of sheet metal, with various areas having corrosion resistant packing installed therein, it will be noted that the present system is not limited to such materials. Relatively high temperature resistant synthetic materials (e.g., ceramics, carbon fiber, etc.) may be used in the construction of the present exhaust system, as desired. The material used is somewhat dependent upon the location of the present system in the exhaust line of a vehicle or other installation. However, the present system may be installed at virtually any location along the length of the system, with installations closer to the engine requiring greater heat resistance, but also providing greater catalytic reaction for a system providing such a feature. Where the installation may run somewhat cooler, the present system may accept electrical or other heating means to increase the temperatures to levels where catalytic reactions are efficient.

The present exhaust system also lends itself to installations on other than Otto cycle (four stroke, spark ignition) engines. Particulate traps may be added to contain carbon and other particles typically emitted by Diesel engines, if so desired. The system may also incorporate cooling chambers to control exhaust gas expansion, and therefore the sound output of such expanding gases. Other technology (e.g., electronic frequency canceling systems, etc.) may also be incorporated with the present exhaust system, as desired. Thus, the present exhaust system even at its most basic level provides significant improvements over the prior art.

It is to be understood that the present invention is not limited to the embodiments described above, but encompasses any and all embodiments within the scope of the following claims.

I claim:

1. An exhaust sound attenuation and control system, comprising:

an elongate external housing, having an inlet end and an outlet end opposite said inlet end;

an inlet end plate and an outlet end plate, respectively secured to and sealing said inlet end and said outlet end of said housing and defining an interior volume therein;

an inlet pipe and an outlet pipe, respectively extending from said inlet end plate and from said outlet end plate, and communicating with said interior volume;

an inlet chamber, an intermediate chamber, and an outlet chamber disposed within said housing, respectively communicating with one another sequentially from said inlet pipe to said outlet pipe and defining a sinusoidal primary exhaust gas passage therethrough, said primary exhaust gas passage has a length at least two and one half times longer than said housing;

a first separator panel separating said inlet chamber from said intermediate chamber; and a second separator panel separating said intermediate chamber from said outlet chamber, said first separator panel and said second separator panel each including a lateral exhaust gas pressure balance passage therethrough, with each said pressure balance passage defining an alternative gas passage path through said interior volume.

2. The exhaust sound attenuation and control system according to claim 1, further including:

a housing internal surface; and an emission reduction material coating disposed upon at least said housing internal surface, said first separator panel, and said second separator panel.

3. The exhaust sound attenuation and control system according to claim 1, wherein:

each said end plate has a convex shape and further comprises an internal plate installed therein, each said end plate and the respective internal plate installed therein defining an end volume; and each said end volume further includes sound absorbent material disposed therein.

4. The exhaust sound attenuation and control system according to claim 1, wherein said housing comprises an inner shell and an outer shell, defining a housing volume therebetween.

5. The exhaust sound attenuation and control system according to claim 4, further including sound absorbent material disposed within said housing volume.

6. An exhaust sound attenuation and control system, comprising:

an elongate external housing, having an inlet end and an outlet end opposite said inlet end;

an inlet end plate and an outlet end plate, respectively secured to and sealing said inlet end and said outlet end of said housing and defining an interior volume therein;

an inlet pipe and an outlet pipe, respectively extending from said inlet end plate and from said outlet end plate, and communicating with said interior volume;

an inlet chamber, an intermediate chamber, and an outlet chamber disposed within said housing, respectively communicating with one another sequentially from said inlet pipe to said outlet pipe and defining a sinusoidal primary exhaust gas passage therethrough;

a first separator panel separating said inlet chamber from said intermediate chamber;

a second separator panel separating said intermediate chamber from said outlet chamber, said first separator panel and said second separator panel each including a lateral exhaust gas pressure balance passage therethrough, with each said pressure balance passage defining an alternative gas passage path through said interior volume;

a first supplementary panel disposed between said first separator panel and said housing, and defining a first supplementary volume between said first supplementary panel and said housing; and a second supplementary panel disposed between said second separator panel and said housing, and defining a second supplementary volume between said second supplementary panel and said housing;

wherein each said supplementary panel includes a plurality of passages therethrough, with said primary exhaust gas passage communicating with said first and said second supplementary volume by means of said supplementary panel passages.

7. An exhaust sound attenuation and control system, comprising:

an elongate external housing, having an inlet end and an outlet end opposite said inlet end;

an inlet end plate and an outlet end plate, respectively secured to and sealing said inlet end and said outlet end of said housing and defining an interior volume therein;

an inlet pipe and an outlet pipe, respectively extending from said inlet end plate and from said outlet end plate, and communicating with said interior volume;

said inlet pipe and said outlet pipe each having a cross-sectional area;

an inlet chamber, an intermediate chamber, and an outlet chamber disposed within said housing, respectively communicating with one another sequentially from said inlet pipe to said outlet pipe and defining a sinusoidal primary exhaust gas passage therethrough, wherein said primary exhaust gas passage has a length at least two and one half times longer than said housing;

a first panel separating said inlet chamber from said intermediate chamber;

a second panel separating said intermediate chamber from said outlet chamber;

said first panel and said housing defining a first primary exhaust gas passage therebetween; and said second panel and said housing defining a second primary exhaust gas passage therebetween;

wherein each said primary exhaust gas passage and said outlet pipe have cross-sectional areas at least equal to said cross-sectional area of said inlet pipe.

8. The exhaust sound attenuation and control system according to claim 7, further including:

a housing internal surface; and an emission reduction material coating disposed upon at least said housing internal surface, said first separator panel, and said second separator panel.

9. The exhaust sound attenuation and control system according to claim 7, wherein:

each said end plate has a convex shape and further comprises an internal plate installed therein, each said end plate and the respective internal plate installed therein defining an end volume; and each said end volume further includes sound absorbent material disposed therein.

10. The exhaust sound attenuation and control system according to claim 7, wherein said housing comprises an inner shell and an outer shell, defining a housing volume therebetween.

11. The exhaust sound attenuation and control system according to claim 10, further including sound absorbent material disposed within said housing volume.

12. An exhaust sound attenuation and control system, comprising:

an elongate external housing, having an inlet end and an outlet end opposite said inlet end;

an inlet end plate and an outlet end plate, respectively secured to and sealing said inlet end and said outlet end of said housing and defining an interior volume therein;

an inlet pipe and an outlet pipe, respectively extending from said inlet end plate and from said outlet end plate, and communicating with said interior volume;

said inlet pipe and said outlet pipe each having a cross-sectional area;

an inlet chamber, an intermediate chamber, and an outlet chamber disposed within said housing, respectively communicating with one another sequentially from said inlet pipe to said outlet pipe and defining a sinusoidal primary exhaust gas passage therethrough;

a first panel separating said inlet chamber from said intermediate chamber;

a second panel separating said intermediate chamber from said outlet chamber;

said first panel and said housing defining a first primary exhaust gas passage therebetween;

said second panel and said housing defining a second primary exhaust gas passage therebetween;

wherein each said primary exhaust gas passage and said outlet pipe have cross-sectional areas at least equal to said cross-sectional area of said inlet pipe;

a first supplementary panel disposed between said first separator panel and said housing, and defining a first supplementary volume between said first supplementary panel and said housing; and a second supplementary panel disposed between said second separator panel and said housing, and defining a second supplementary volume between said second supplementary panel and said housing;

wherein each said supplementary panel includes a plurality of passages therethrough, with said primary exhaust gas passage communicating with said first and said second supplementary volume by means of said supplementary panel passages.

13. An exhaust sound attenuation and control system, comprising:

an elongate exteral housing, having an inlet end and an outel opposite said inlet end;

an inlet end plate and an outlet end plate, respectively secured to and sealing said inlet end and said outlet end of said housing and defining an interior volume therein;

an inlet pipe and an outlet pipe, respectively extending from said inlet end plate and from said outlet end plate, and communicating with said interior volume;

each said pipe having a first side, a second side opposite said first side, and a cross-sectional area;

a first separator panel having a first end sealed to said inlet end plate adjacent said second side of said inlet pipe, and extending angularly through the majority of said housing to a second end spaced apart from said housing;

a second separator panel having a first end sealed to said outlet end plate adjacent said first side of said outlet pipe, extending angularly through the majority of said housing to a second end spaced apart from said housing, and disposed parallel to said first separator panel;

said first separator panel and said second separator panel each including a lateral exhaust gas pressure balance passage therethrough, with each said pressure balance passage defining an alternative gas passage path through said interior volume;

a first supplementary panel having a first end sealed to said inlet end plate adjacent said first side of said inlet pipe, sealed to said housing and disposed parallel to said first separator panel;

a second supplementary panel having a first end sealed to said outlet end plate adjacent said second side of said outlet pipe, sealed to said housing and disposed parallel to said second separator panel;

said first separator panel and said first supplementary panel defining an inlet chamber therebetween;

said first and said second separator panel defining an intermediate chamber therebetween;

said second separator panel and said second supplementary panel defining an outlet chamber therebetween;

said inlet chamber, said intermediate chamber, and said outlet chamber respectively communicating with one another sequentially from said inlet pipe to said outlet pipe and defining a sinusoidal primary exhaust gas passage therethrough;

said primary exhaust gas passage and said outlet pipe having cross-sectional areas at least equal to said cross-sectional area of said inlet pipe;

an intermediate chamber entry baffle having a passage therethrough, extending across said housing and between said second end of said first separator panel, and said second separator panel;

an intermediate chamber exit baffle having a passage therethrough, extending across said housing and between said second end of said second separator panel, and said first separator panel; and a plurality of chevron-shaped intermediate baffles disposed between said entry baffle and said exit baffle of said intermediate chamber, and extending between said first and said second separator panel, each of said intermediate baffles having a progressively smaller width from said entry baffle toward said exit baffle.

14. The exhaust sound attenuation and control system according to claim 13, further including:

a housing internal surface; and an emission reduction material coating disposed upon at least said housing internal surface, each said separator panel, each said supplementary panel, said entry baffle, said exit baffle, and each of said intermediate baffles.

15. The exhaust sound attenuation and control system according to claim 13, wherein said primary exhaust gas passage has a length at least two and one half times longer than said housing.

16. The exhaust sound attenuation and control system according to claim 13, wherein:

said first and said second supplementary panel respectively define first and second supplementary volumes between each said supplementary panel and said housing;

each said supplementary panel further includes a plurality of passages therethrough;

each said end plate has a convex shape and further comprises an internal plate installed therein, each said end plate and the respective internal plate installed therein defining an end volume;

each said internal plate further includes a plurality of passages therethrough;

said primary exhaust gas passage communicates with each said supplementary volume and each said end volume respectively by means of said passages of each said supplementary panel and said passages of each said internal plate; and each said supplementary volume and each said end volume further include sound absorbent material disposed therein.

17. The exhaust sound attenuation and control system according to claim 13, wherein:

said housing comprises an inner shell and an outer shell, defining a housing volume therebetween; and said housing volume further includes sound absorbing material disposed therein.

18. The exhaust sound attenuation and control system according to claim 13, further including:

an internal entry pipe extending from said passage of said entry baffle, and directing exhaust gas flow toward the first of said plurality of intermediate baffles; and an internal exit pipe extending from said passage of said exit baffle toward said inlet end plate.

* * * * *